APPARATUS FOR AUTOMATICALLY FEEDING SHEETS

BACKGROUND OF THE INVENTION

The present invention relates to an apparatus for automatically feeding sheets one by one from a stack of sheets.

Such a sheet feeding apparatus can be used in a facsimile unit, an electrophotographic copying machine and the like. For instance, in an electrophotographic copying machine the above sheet feeding apparatus is sometimes provided as an automatic document feeder which can feed the stacked documents one by one onto a template for projecting an image of a document onto an electrophotographic photosensitive member such as a photosensitive drum.

FIG. 1 shows an embodiment of a known document feeding apparatus comprising a document feed mechanism 5 having a feeding roller 1 rotated in the direction shown by an arrow, a pressing roller 2 arranged opposite to the feeding roller 1 and an arm 4 pivotally supported by a shaft 3. The pressing roller 2 is rotatably supported on the free end of the arm 4. At an upstream position, viewed in the document feed direction, is provided a document separating mechanism 6. A stack of documents 8 to be fed one by one is placed on a document table 7 and is clamped between the feeding roller 1 and the pressing roller 2. When the feeding roller 1 is rotated, the stack of documents 8 is fed toward the document separating mechanism 6 which comprises a separating roller 9 rotated in the direction shown by an arrow, a pressing plate 10 arranged in an inclined fashion with the sheet feed direction and a frictional sheet 11 applied on that surface of the plate 10 which is facing the roller 9. Then the lowermost document is separated from the stack of documents 8 and is further fed forward by means of the feeding rollers 1 and 9, while the remaining documents are retained in position by the separating mechanism 6. In this manner the documents are fed successively from the lowermost one in the stack of documents 8. During this feeding operation, the arm 4 is rotated about the shaft 3 in the counter-clockwise direction in accordance with the decrease in the thickness T of the document stack 8 so that the variation of the thickness T, i.e., the number of documents in the stack 8, can be compensated for.

In such a known apparatus the stack of documents 8 is clamped between the feeding roller 1 and the pressing roller 2 only with a small force due to the gravitational force of the roller 2 and arm 4, and thus between the lowermost document and the feeding roller 1 there is not produced a sufficiently large frictional force for feeding the lowermost document. Particularly when the number of stacked documents 8 is large, there might be produced between the lowermost document and the document table 7, a somewhat large frictional force which is sometimes larger than that produced between the feeding roller 1 and the lowermost document, and thus, the document could not be fed positively and stably.

In order to avoid such a disadvantage it has been proposed, as shown in FIG. 2, to arrange a coiled spring 12 between the arm 4 and a fixed member so as to increase the frictional force generated between the lowermost document and the feeding roller 1. However, in such a known apparatus, when the number of the stacked documents 8 becomes small, there might be produced a serious problem, which will be explained hereinbelow. Such a problem becomes noticeable when the document is a thin sheet such as tracing paper.

When the number of the stacked documents 8 is large as illustrated in FIG. 3A, the sheets are smoothly fed one by one by the feeding and separating mechanisms 5 and 6 even if the documents are thin. However, since the stacked documents are compressed between the feeding roller 1 and the pressing roller 2 by means of the relatively strong restoring force of the spring 12, a large frictional force is produced between the successive documents. Therefore, when the lowermost document **8*a* is fed by the feeding rollers 1 and 9 as shown in FIG. 3B, the remaining documents above the lowermost document 8*a* are also advanced together with the lowermost sheet 8*a*. However, the advance of these documents is suppressed by the friction plate 11 and thus they start bending upward as illustrated in FIG. 3B. The degree of this bending becomes larger as shown in FIGS. 3C and 3D in accordance with the advance of the lowermost document 8*a*. When the documents are bent to a great extent as shown in FIG. 3D**, so-called jamming is produced and the documents are clogged in the feeding apparatus. When such jamming is produced, the documents, i.e., valuable originals, are damaged to an impermissible extent. Further, once the jamming occurs, the operation of the apparatus should be stopped and the jammed documents must be removed carefully. This results in troublesome work and lack of reliability.

SUMMARY OF THE INVENTION

The present invention has for its object to provide a novel and useful automatic sheet feeding apparatus which can effectively avoid the above mentioned drawbacks of the known apparatuses and can feed stacked sheets one by one in a positive and stable manner by clamping the stacked sheets with a larger force when the stack of sheets has a larger thickness, but with a smaller force when the thickness of the stack becomes smaller.

According to the invention an automatic sheet feeding apparatus comprises means arranged below a stack of sheets for feeding the sheets one by one from the lowermost sheet which is made to contact the feeding means;

means arranged above the stack of sheets for pressing the stack of sheets against the feeding means with a first force when the thickness of the stack of sheets is larger than a predetermined value, and with a second force which is smaller than said first force when the thickness of the stack of sheets is at most equal to said predetermined value; and means arranged at a downstream position viewed in a sheet feed direction for separating the lowermost sheet from the stack of sheets to feed the thus separated sheet forward.

APPARATUS FOR AUTOMATICALLY FEEDING SHEETS

BACKGROUND OF THE INVENTION

The present invention relates to an apparatus for automatically feeding sheets one by one from a stack of sheets.

Such a sheet feeding apparatus can be used in a facsimile unit, an electrophotographic copying machine and the like. For instance, in an electrophotographic copying machine the above sheet feeding apparatus is sometimes provided as an automatic document feeder which can feed the stacked documents one by one onto a template for projecting an image of a document onto an electrophotographic photosensitive member such as a photosensitive drum.

Figure 1:
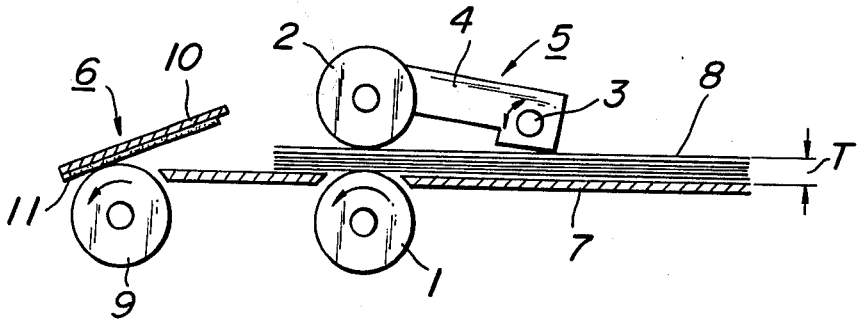
FIG. 1 PRIOR ART
FIG. 1 is a cross section showing an embodiment of a known automatic sheet feeding apparatus.

FIG. 1 shows an embodiment of a known document feeding apparatus comprising a document feed mechanism 5 having a feeding roller 1 rotated in the direction shown by an arrow, a pressing roller 2 arranged opposite to the feeding roller 1 and an arm 4 pivotally supported by a shaft 3. The pressing roller 2 is rotatably supported on the free end of the arm 4. At an upstream position, viewed in the document feed direction, is provided a document separating mechanism 6. A stack of documents 8 to be fed one by one is placed on a document table 7 and is clamped between the feeding roller 1 and the pressing roller 2. When the feeding roller 1 is rotated, the stack of documents 8 is fed toward the document separating mechanism 6 which comprises a separating roller 9 rotated in the direction shown by an arrow, a pressing plate 10 arranged in an inclined fashion with the sheet feed direction and a frictional sheet 11 applied on that surface of the plate 10 which is facing the roller 9. Then the lowermost document is separated from the stack of documents 8 and is further fed forward by means of the feeding rollers 1 and 9, while the remaining documents are retained in position by the separating mechanism 6. In this manner the documents are fed successively from the lowermost one in the stack of documents 8. During this feeding operation, the arm 4 is rotated about the shaft 3 in the counter-clockwise direction in accordance with the decrease in the thickness T of the document stack 8 so that the variation of the thickness T, i.e., the number of documents in the stack 8, can be compensated for.

In such a known apparatus the stack of documents 8 is clamped between the feeding roller 1 and the pressing roller 2 only with a small force due to the gravitational force of the roller 2 and arm 4, and thus between the lowermost document and the feeding roller 1 there is not produced a sufficiently large frictional force for feeding the lowermost document. Particularly when the number of stacked documents 8 is large, there might be produced between the lowermost document and the document table 7, a somewhat large frictional force which is sometimes larger than that produced between the feeding roller 1 and the lowermost document, and thus, the document could not be fed positively and stably.

Figure 2:
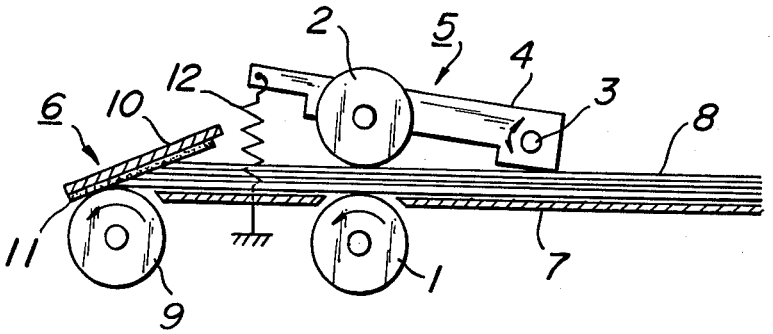
FIG. 2 PRIOR ART
FIG. 2 is a cross section illustrating another embodiment of a known automatic sheet feeding apparatus.

In order to avoid such a disadvantage it has been proposed, as shown in FIG. 2, to arrange a coiled spring 12 between the arm 4 and a fixed member so as to increase the frictional force generated between the lowermost document and the feeding roller 1. However, in such a known apparatus, when the number of the stacked documents 8 becomes small, there might be produced a serious problem, which will be explained hereinbelow. Such a problem becomes noticeable when the document is a thin sheet such as tracing paper.

Figure 3A:
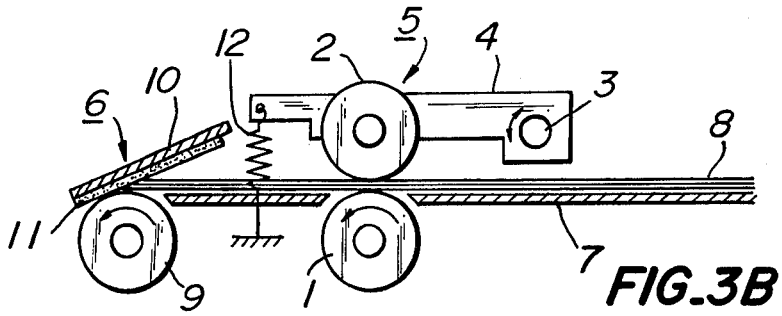
FIG 3A PRIOR ART
FIGS. 3A to 3D are cross sections for explaining how a jam is produced in the known apparatus shown in FIG. 2.
Figure 3B:
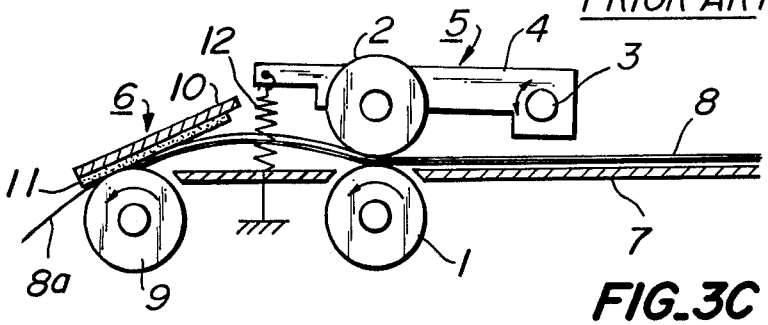
FIG 3B PRIOR ART
Figure 3C:
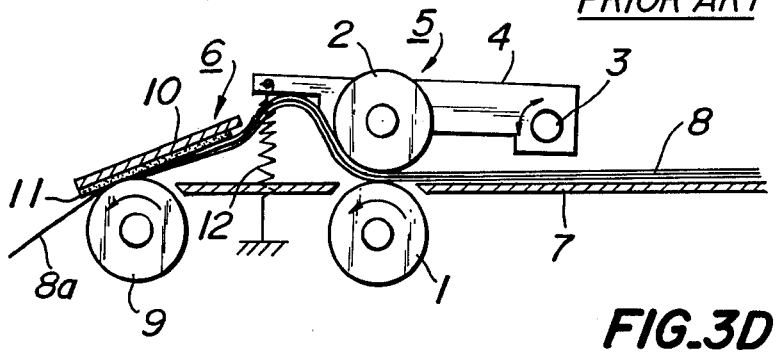
FIG 3C PRIOR ART
Figure 3D:
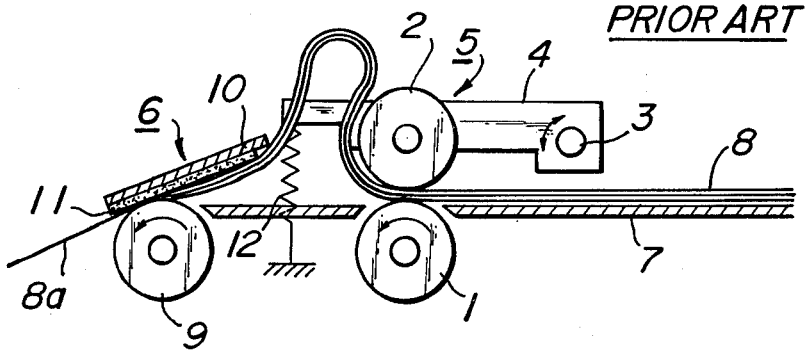
FIG 3D PRIOR ART

When the number of the stacked documents 8 is large as illustrated in FIG. 3A, the sheets are smoothly fed one by one by the feeding and separating mechanisms 5 and 6 even if the documents are thin. However, since the stacked documents are compressed between the feeding roller 1 and the pressing roller 2 by means of the relatively strong restoring force of the spring 12, a large frictional force is produced between the successive documents. Therefore, when the lowermost document **8*a* is fed by the feeding rollers 1 and 9 as shown in FIG. 3B, the remaining documents above the lowermost document 8*a* are also advanced together with the lowermost sheet 8*a*. However, the advance of these documents is suppressed by the friction plate 11 and thus they start bending upward as illustrated in FIG. 3B. The degree of this bending becomes larger as shown in FIGS. 3C and 3D in accordance with the advance of the lowermost document 8*a*. When the documents are bent to a great extent as shown in FIG. 3D**, so-called jamming is produced and the documents are clogged in the feeding apparatus. When such jamming is produced, the documents, i.e., valuable originals, are damaged to an impermissible extent. Further, once the jamming occurs, the operation of the apparatus should be stopped and the jammed documents must be removed carefully. This results in troublesome work and lack of reliability.

SUMMARY OF THE INVENTION

The present invention has for its object to provide a novel and useful automatic sheet feeding apparatus which can effectively avoid the above mentioned drawbacks of the known apparatuses and can feed stacked sheets one by one in a positive and stable manner by clamping the stacked sheets with a larger force when the stack of sheets has a larger thickness, but with a smaller force when the thickness of the stack becomes smaller.

According to the invention an automatic sheet feeding apparatus comprises means arranged below a stack of sheets for feeding the sheets one by one from the lowermost sheet which is made to contact the feeding means;

means arranged above the stack of sheets for pressing the stack of sheets against the feeding means with a first force when the thickness of the stack of sheets is larger than a predetermined value, and with a second force which is smaller than said first force when the thickness of the stack of sheets is at most equal to said predetermined value; and means arranged at a downstream position viewed in a sheet feed direction for separating the lowermost sheet from the stack of sheets to feed the thus separated sheet forward.

BRIEF DESCRIPTION OF THE DRAWINGS

Figure 4A:
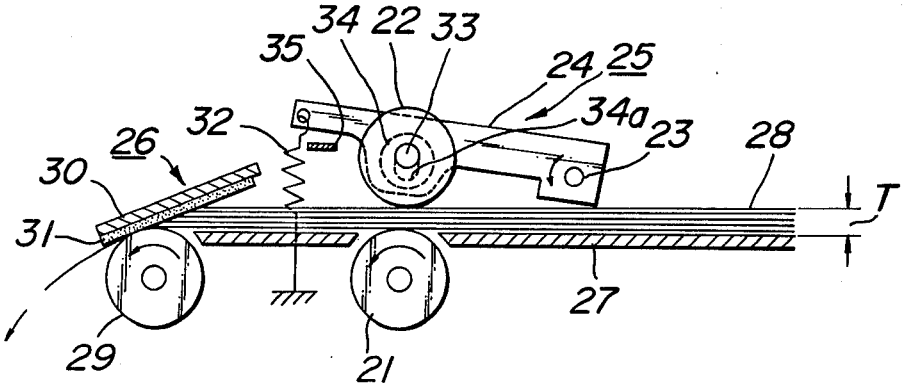
Figure 4B:
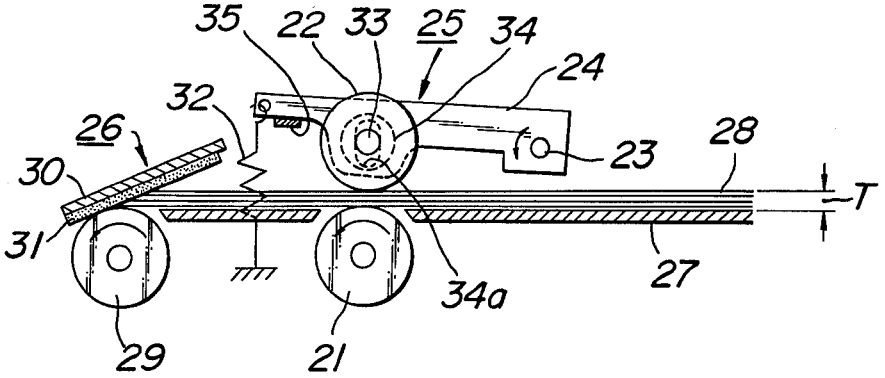
Figure 5A:
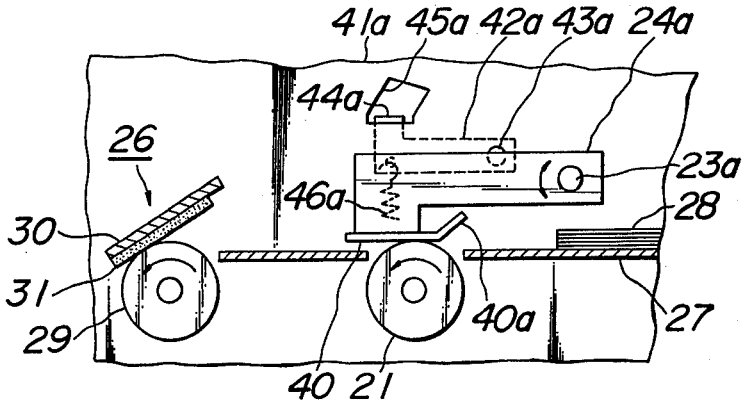
Figure 5B:
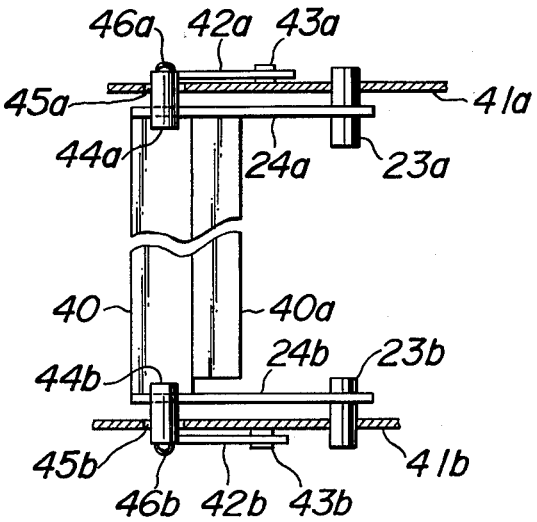
Figure 5C:
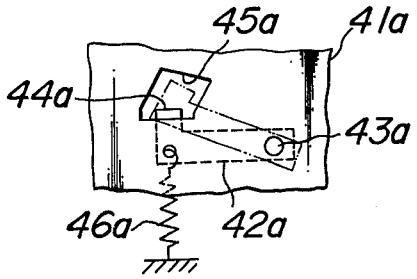
Figure 6:
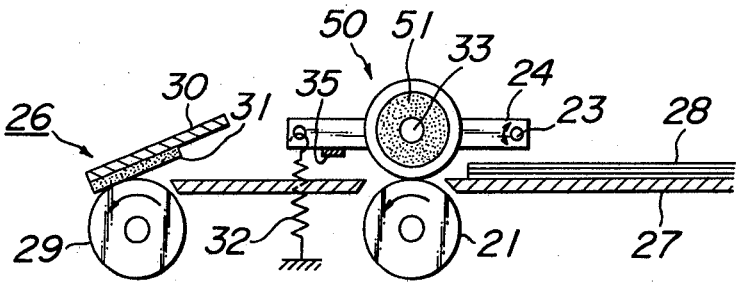
Figure 7:
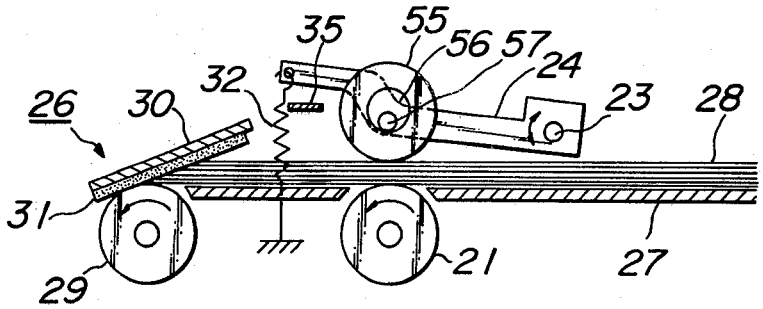

FIG. 1 is a cross section showing an embodiment of a known automatic sheet feeding apparatus;

FIG. 2 is a cross section illustrating another embodiment of a known automatic sheet feeding apparatus;

FIGS. 3A to 3D are cross sections for explaining how a jam is produced in the known apparatus shown in FIG. 2;

FIGS. 4A and 4B are cross sections showing an embodiment of the automatic sheet feeding apparatus according to the invention;

FIGS. 5A to 5C are cross sections and schematic views showing another embodiment of the automatic sheet feeding apparatus according to the invention;

FIG. 6 is a cross section depicting another embodiment of the automatic sheet feeding apparatus according to the invention; and FIG. 7 is a cross section showing still another embodiment of the automatic sheet feeding apparatus according to the invention.

DESCRIPTION OF THE PREFERRED EMBODIMENTS

FIGS. 4A and 4B show an embodiment of the automatic sheet feeding apparatus according to the invention. The apparatus comprises a feeding roller 21 which is arranged below a stack of sheets 28 placed on a sheet table 27 and is rotated in the direction shown by an arrow. The stack of sheets 28 is urged against the feeding roller 21 by means of a pressing roller 22 rotatably supported by an arm 24 which is journaled by a shaft 23. The feeding roller 21, the pressing roller 22 and the arm 24 constitute a sheet feeding mechanism 25 together with a coiled spring 32 provided between a free end of arm 24 and a fixed member. At a downstream position with respect to the sheet feeding mechanism 25 is arranged a sheet separating mechanism 26 comprising a separating and feeding roller 29 rotated in the direction shown by an arrow, a pressing plate 30 and a friction sheet 31 applied on the pressing plate 30.

The construction so far explained is same as that of the known apparatus shown in FIG. 2. According to the present invention, the shaft 33 of the pressing roller 22 is inserted into an elongated hole 34*a* formed in a bearing 34 secured to the arm 24 and thus, the shaft 33 can move along the elongated hole 34*a*. At the same time there is arranged a stopper 35 in a rotational locus of the arm 24 at such a position that when the thickness T of the stacked sheets 28 becomes a predetermined value $T_R$, the arm 24 is in contact with the stopper 35. As illustrated in FIG. 4A when the thickness T of the stacked sheets 28 is larger than the predetermined value $T_R$, i.e., the number of the stacked sheets is larger than the predetermined number, the arm 24 is lifted by the roller shaft 33 and is not brought into contact with the stopper 35, and thus the shaft 33 of the pressing roller 22 is engaged with the upper edge of the elongated hole 34*a* of the bearing 34. In this manner, the roller 22 is urged against the stacked sheets 28 with a strong force due to the restoring force of the spring 32 and the gravitational force of the roller 22 and arm 24. Therefore, a sufficiently large frictional force is produced between the feeding roller 21 and the lowermost sheet for feeding the stack of sheets 28 forwardly, even if the number of sheets is large and the stack of sheets is heavy. The stacked sheets 28 are fed into the sheet separating mechanism 26 and are further fed one by one from the lowermost sheet.

As the sheets are successively fed and the thickness T of the stack of sheets becomes the given value $T_R$, the arm 24 comes into contact with the stopper 35. After that the arm 24 can not rotate in the counter-clockwise direction and then only the pressing roller 22 moves downward, because its shaft 33 is supported in the elongated hole 34*a* of bearing 34. Therefore, after the thickness of the stacked sheets 28 has decreased to the predetermined value $T_R$, the restoring force of the coiled spring 32 and the gravitational force of the arm 24 are no longer exerted upon the pressing roller 22 and thus, the pressing roller 22 is urged against the stack of sheets 28 with a small force due only to its gravitational force. In this manner, according to the invention, the sheets can be effectively prevented from being bent and jamming can be fully avoided.

FIGS. 5A to 5C show another embodiment of a sheet feeding apparatus according to the invention. In this embodiment portions similar to those of the previous embodiment are denoted by the same reference numerals used in FIGS. 4A and 4B. In this embodiment, use is made of a pressing plate 40 instead of the pressing roller. That is, the pressing plate 40 is connected to a pair of arms 24*a* and 24*b* which are pivotally supported by a pair of shafts 23*a* and 23*b*, respectively. The front edge 40*a* of the pressing plate 40 is bent upward so as to ease the insertion of a stack of sheets 28 between the feeding roller 21 and the pressing plate 40. The shafts 23*a* and 23*b* are secured to side walls 41*a* and 41*b* of the apparatus, respectively. Along the side walls 41*a* and 41*b* are arranged levers 42*a* and 42*b*, respectively, in such a manner that the levers are rotatable about pins 43*a* and 43*b*, respectively. Free ends of the levers 42*a* and 42*b* are bent so as to form projections 44*a* and 44*b*, respectively, and these projections extend inwardly through openings 45*a* and 45*b* which are formed in the side walls 41*a* and 41*b*, respectively, to such an extent that the projections 44*a* and 44*b* extend into the rotational loci of the arms 24*a* and 24*b* and can be made to contact the upper edges of the arms. The openings 45*a* and 45*b* have such dimensions that the arms 24*a*, 24*b* can rotate in the clockwise direction in FIG. 5A to a sufficiently large angle for allowing the insertion of the stack of sheets 28 between the feeding roller 21 and the pressing plate 40. As best shown in FIG. 5C, between the levers 42*a* and 42*b* and a fixed member are arranged coiled springs 46*a* and 46*b*, respectively, and therefore the levers 42*a*, 42*b* and thus the arms 24*a*, 24*b*, are biased to rotate in the counter-clockwise direction.

When the thickness of the stacked sheets 28 is thicker than the predetermined value, the arms 24*a*, 24*b* are urged against the projections 44*a*, 44*b* of levers 42*a*, 42*b* and thus, the pressing plate 40 is urged against the stack of sheets 28 with a strong force caused by the restoring force of the coiled springs 46*a*, 46*b* and the gravitational force of the pressing plate 40, the arms 24*a*, 24*b* and the levers 42*a*, 42*b*. As a result of this, the thick stack of sheets 28 can be positively fed one by one.

When the number of sheets of the stack 28 is small and the thickness of the sheet stack 28 becomes less than the predetermined value $T_R$, the projections 44*a*, 44*b* of levers 42*a*, 42*b* are in contact with the lower edges of openings 45*a*, 45*b* formed in the side walls 41*a*, 41*b* and thus the levers 42*a*, 42*b* can not be further rotated in the counter-clockwise direction in FIG. 5A. Therefore, the pressing plate 40 is urged against the stack of sheets 28 with a small force due to the gravitational force of the plate 40 and the arms 24*a*, 24*b*, and the sheets can be effectively fed without causing undesired jamming.

FIG. 6 is a cross section depicting another embodiment of a sheet feeding apparatus according to the invention. In this embodiment the similar portions as those shown in the previous embodiments are designated by the same reference numerals used in FIGS. 4A and 4B. In this embodiment, the rotational movement of an arm 24 in the counter-clockwise direction about a shaft 23 is inhibited by a stopper 35. A pressing roller 50 journaled by a shaft 33 comprises a resilient sleeve 51 made of foamed rubber. Therefore, after the arm 24 is in contact with the stopper 35, the stack of sheets 28 is pressed against the feeding roller 21 with a small force due to the restoring force of the deformed sleeve 51 of the pressing roller 50.

FIG. 7 is a cross section showing still another embodiment of the sheet feeding apparatus according to the invention. In the present embodiment pressing means is formed by a sleeve like roller 55 having a hole 56 of a relatively large diameter and a pin 57 secured to an arm 24 pivoted about a shaft 23 is inserted in the hole 56 of the roller 55. When the thickness of a stack of sheets 28 is larger than the predetermined value $T_R$, the arm 24 is lifted upward by the engagement of the hole 56 and the pin 57 and thus, the pressing roller 55 is urged against the stacked sheets 28 with a greater force due to the restoring force of the coiled spring 32 and the gravitational force of the roller 55. On the other hand, when the thickness of the sheet stack 28 becomes lower than the predetermined value $T_R$, the rotation of the arm 24 is inhibited by the stopper 35 and the roller 55 is urged against the stacked sheets 28 with a smaller force due only to its gravitational force.

As explained above in detail, according to the invention the stack of sheets can always be pressed against the feeding roller with a suitable force which is varied automatically in accordance with the change in thickness of the stack of sheets, and therefore the sheets can be fed one by one from the lowermost one in a positive and safe manner without causing undesired jamming of sheets regardless of the thickness of the stacked sheets.

It should be noted that the present invention is not limited to the embodiments explained above, but may be modified in various manners within the scope of the invention. For instance, the coiled spring 32 may be provided at a position between the arm 24 and the shaft 23, and similarly the coiled springs 46*a*, 46*b* may be provided at positions between the levers 42*a*, 42*b* and the pins 43*a*, 43*b*, respectively.

What is claimed is:

1. An automatic sheet feeding apparatus comprising:

means arranged below a stack of sheets for feeding the sheets one by one from the lowermost sheet which is in contact with the feeding means;

means arranged above the stack of sheets for pressing the stack of sheets against the feeding means with a first force when the thickness of the stack of sheets is larger than a predetermined value, and with a second force which is smaller than said first force when the thickness of the stack of sheets is at most equal to said predetermined value, said pressing means including:

a first pressing member which is movable in a substantially vertical direction to produce said second force due to the gravitational force of the pressing member;

a second pressing member loosely coupled with said first pressing member for urging said first pressing member against the stack of sheets to produce said first force; and a stopper member for inhibiting the operation of said second pressing member after the thickness of said stack of sheets has decreased to said predetermined value while permitting the operation of said first pressing member;

means arranged at a downstream position viewed in a sheet feed direction for separating the lowermost sheet from the stack of sheets to feed the thus separated sheet forward.

2. An automatic sheet feeding apparatus comprising:

means arranged below a stack of sheets for feeding the sheets one by one from the lowermost sheet which is in contact with the feeding means;

means arranged above the stack of sheets for pressing the stack of sheets against the feeding means with a first force when the thickness of the stack of sheets is larger than a predetermined value, and with a second force which is smaller than said first force when the thickness of the stack of sheets is at most equal to said predetermined value, said pressing means including:

a first pressing member which is movable in a substantially vertical direction to produce said second force due to the gravitational force of the pressing member;

a second pressing member loosely coupled with said first pressing member for urging said first pressing member against the stack of sheets to produce said first force; and a stopper member for inhibiting the operation of said second pressing member after the thickness of said stack of sheets has decreased to said predetermined value;

said first pressing member comprises a pressing roller, said second pressing member comprises a rotatable arm with which said pressing roller is loosely coupled and a spring connected to the arm for rotating the arm in such a direction that the pressing roller is urged against the stack of sheets, and said stopper member is arranged in a rotational locus of the arm at such a position that the arm is in contact with the stopper member when the thickness of the stack of sheets has decreased to said predetermined value;

means arranged at a downstream position viewed in a sheet feed direction for separating the lowermost sheet from the stack of sheets to feed the thus separated sheet forward.

3. An apparatus according to claim 2, wherein said arm has secured thereto a bearing having an elongated hole and said pressing roller has a shaft movably inserted in said elongated hole of the bearing.

4. An apparatus according to claim 3, wherein said pressing roller is formed by a sleeve like roller having a central hole of a large diameter and said arm has a pin of a small diameter inserted into said center hole of the sleeve like roller.

5. An apparatus according to claim 2, wherein said spring is formed by a coiled spring connected between a free end of said rotatable arm and a fixed member of the apparatus.

6. An apparatus according to claim 1, wherein said first pressing member comprises a pressing plate and a rotatable arm to which said pressing plate is secured, and said second pressing member comprises a rotatable lever arranged beside said arm, a projection connected to a free end of the lever and extending into the rotational locus of the arm, and a spring connected to the lever for rotating the lever in such a direction that the pressing plate is urged against the stack of sheets via an engagement with the projection and the arm, and said stopper member is provided in the rotational locus of the lever or projection at such a position that the lever or projection is in contact with the stopper member when the thickness of the stack of sheets has decreased to said predetermined value.

7. An apparatus according to claim 6, wherein said stopper member is formed by an opening formed in a fixed member and said projection is extended through said opening.

8. An apparatus according to claim 6, wherein said spring is connected between a free end of the lever and a fixed member.

9. An apparatus according to claim 1, wherein said pressing means comprises a pressing roller made of resilient material, a rotatable arm supporting said pressing roller, a spring connected to a free end of said arm and a fixed member, and said stopper member provided in the rotational locus of the arm at such a position that after the thickness of the stack of sheets has decreased to said predetermined value, the rotation of said arm is inhibited and the stack of sheets is urged against the feeding means by said second force due only to the restoring force of said resilient pressing roller.

10. An apparatus according to any one of claims 1 to 9, wherein said feeding means comprises a feeding roller which is rotated in a given direction.

11. An apparatus according to any one of claims 1 to 9, wherein said separating means comprises a separating roller rotated in a given direction and being in contact with the lowermost sheet, a pressing plate arranged above the separating roller in an inclined fashion with respect to the sheet feed direction and a friction sheet applied on that surface of said plate which faces the separating roller.

* * * * *